United States Patent [19]

White

[11] 3,936,981

[45] Feb. 10, 1976

[54] DENTAL MODEL TRIMMER

[76] Inventor: Velton C. White, c/o V.C. Labs, Inc., 17 N. Broadway, Des Plaines, Ill. 60016

[22] Filed: May 6, 1974

[21] Appl. No.: 467,060

[52] U.S. Cl. ..... 51/125; 51/267; 51/272; 51/406

[51] Int. Cl.[2] ..... B24B 27/00; B24B 55/04

[58] Field of Search ..... 51/125, 128, 268, 269, 51/272, 267, 376–378, 389, 395 51/397, 398, 405–407

[56] References Cited

UNITED STATES PATENTS

| | | | |
|---|---|---|---|
| 959,054 | 5/1910 | Glover | 51/398 |
| 1,711,015 | 4/1929 | Dailey | 51/267 X |
| 1,842,538 | 1/1932 | Burgess | 51/272 X |
| 2,248,953 | 7/1941 | Bunch | 51/128 |
| 2,538,532 | 1/1951 | Oliver | 51/267 X |
| 2,696,700 | 12/1954 | Tocci | 51/378 |
| 2,991,599 | 7/1961 | Else | 51/267 |
| 2,996,851 | 8/1961 | Gianatasio | 51/378 |
| 3,064,400 | 11/1962 | Johnson | 51/128 |
| 3,157,009 | 11/1964 | Barkley | 51/273 |
| 3,310,915 | 3/1967 | Wehmer | 51/128 |
| 3,481,086 | 12/1969 | Paterson | 51/128 |

FOREIGN PATENTS OR APPLICATIONS

| | | | |
|---|---|---|---|
| 168,409 | 11/1950 | Germany | 51/267 |
| 1,177,635 | 4/1959 | France | 51/267 |

*Primary Examiner*—Al Lawrence Smith
*Assistant Examiner*—Nicholas P. Godici
*Attorney, Agent, or Firm*—Olson, Trexler, Wolters, Bushnell & Fosse, Ltd.

[57] ABSTRACT

A dental model trimming machine is provided. A wheel is adapted to concentrically mount a number of abrasively faced disks to provide both coarse and fine grinding surfaces on the same wheel. Two housing members are provided with flanges, and a gasket is mounted in the corner of one housing; when the housing members are telescoped together, the gasket is compressed and an effective seal is provided. Quick-release clamps permit removal of one housing member for removing and replacing a grinding disk.

4 Claims, 6 Drawing Figures

DENTAL MODEL TRIMMER

BACKGROUND OF THE INVENTION

This invention relates generally to dental model trimming machines.

Modern dentistry often requires the preparation of cast plaster models of a patient's dental anatomy. These dental casts or models are used to study a patient's dental anatomy when fitting false teeth, braces, or engaging in other work. During the preparation of these plaster models, good practice requires grinding away part of each rough model or cast to provide relatively standardized facets or faces oriented generally parallel to the rows of teeth. Other facets or faces are provided at the heels or rear ends of the models in a plane at least generally parallel to the medial line of the cast tooth arch, and approximately equidistantly from the two rear molar casts.

These grinding or faceting operations are usually performed on a grinding machine or dental model trimming machine. Typically, a trimming machine includes an abrasive wheel and a work-supporting shelf adjacent the wheel upon which the model or cast is supported while the facets are being ground. Model orienting devices called angulators are often carried upon the work supporting shelf to engage the workpiece cast model and to precisely orient it in a predetermined angular position for grinding.

Extended use of the trimming machine inevitably wears out the abrasive on the abrasive wheel and requires its replacement. Until now, such replacement has been sometimes difficult, since many abrasive wheels are mounted directly to the hub of a motor shaft for relatively high speed rotation. Other model trimmers use rigid wheels permanently or semipermanently faced with an abrasive surface. Moreover, these wheels are surrounded by a housing adapted to retain groundaway grit, abraded plaster material and flushing or grinding fluids such as water. Thus, when it is desired to replace or change a grinding wheel or the face of a grinding wheel, the machine must be stopped, the housing disassembled, and the wheel removed or a new grinding face emplaced upon a backup wheel. Complex machine construction demands lengthy delays to accomplish this work.

Moreover, most prior machines provided only a single grinding face having a single grit size or a single abrasive quality. The abrasiveness of the grinding face was usually selected as a compromise between a coarse grinding grit providing rapid but coarse facet formation, and a find grinding grit providing slow but smooth and accurate facet formation. This compromise prevented rapid abrasive work for preliminary model forming, and further prevented relatively careful, slow final facet smoothing and finishing.

It is the general object of the invention to provide a model trimmer which will quickly trim dental models and provide model facets of high accuracy and quality.

A more specific object of the present invention is to provide an improved model trimming machine providing a plurality of different grinding surfaces mounted for common motion past a work station.

Another object is to provide a model trimmer wherein a grinding surface can be quickly and easily changed or replaced.

Yet another object is to provide a model trimmer having a substantially splash-free, substantially leakfree housing capable of accommodating copious amounts of cooling and flushing water.

Still another object is to provide a model trimmer having the above features in a compact yet rugged device of long service life and relatively maintenance-free, trouble-free operation.

Other objects and advantages of the invention will become apparent upon reading the following detailed description and upon reference to the drawings. Throughout the description, like reference numerals refer to like parts.

DETAILED DESCRIPTION

While the invention will be described in connection with a preferred embodiment, it will be understood that it is not intended to limit the invention to this embodiment. On the contrary, it is intended to cover all alternatives, modifications and equivalents as may be included within the spirit and scope of the invention.

Figure 1:
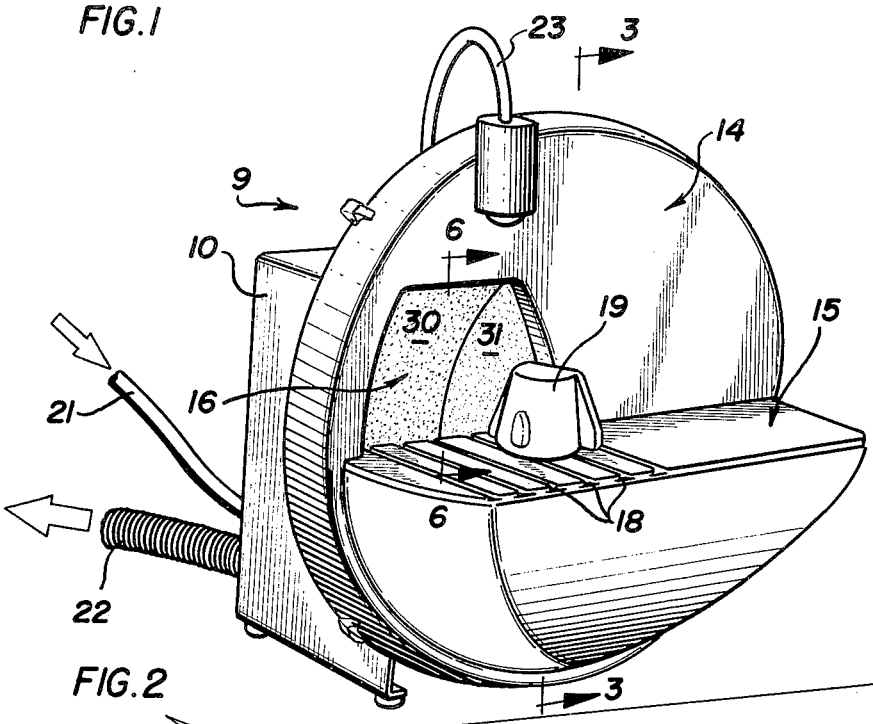
FIG. 1 is a general perspective view of an embodiment of the present invention.
Figure 2:
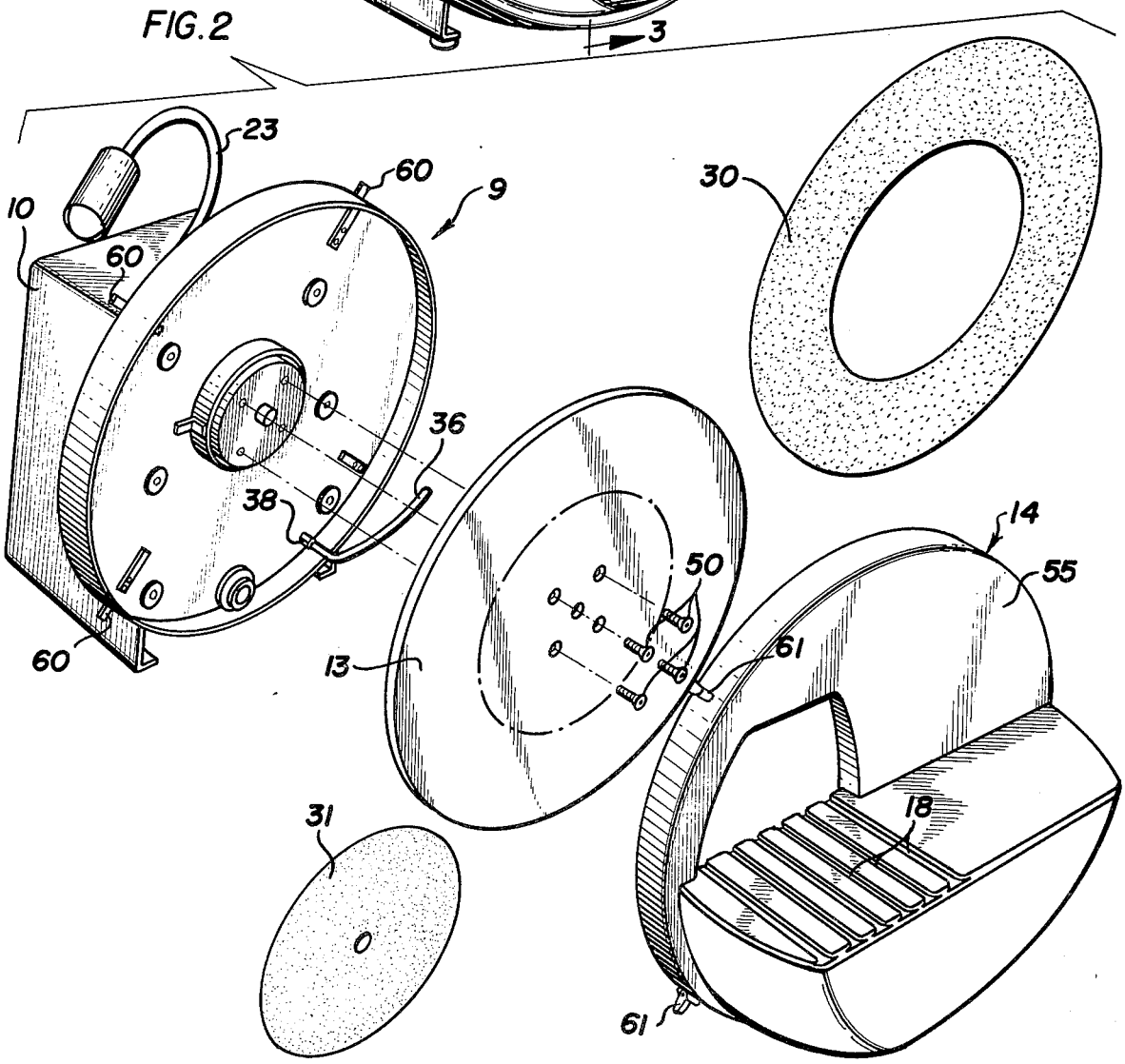
FIG. 2 is an exploded view showing principle parts of the invention embodiment shown in FIG. 1.
Figure 3:
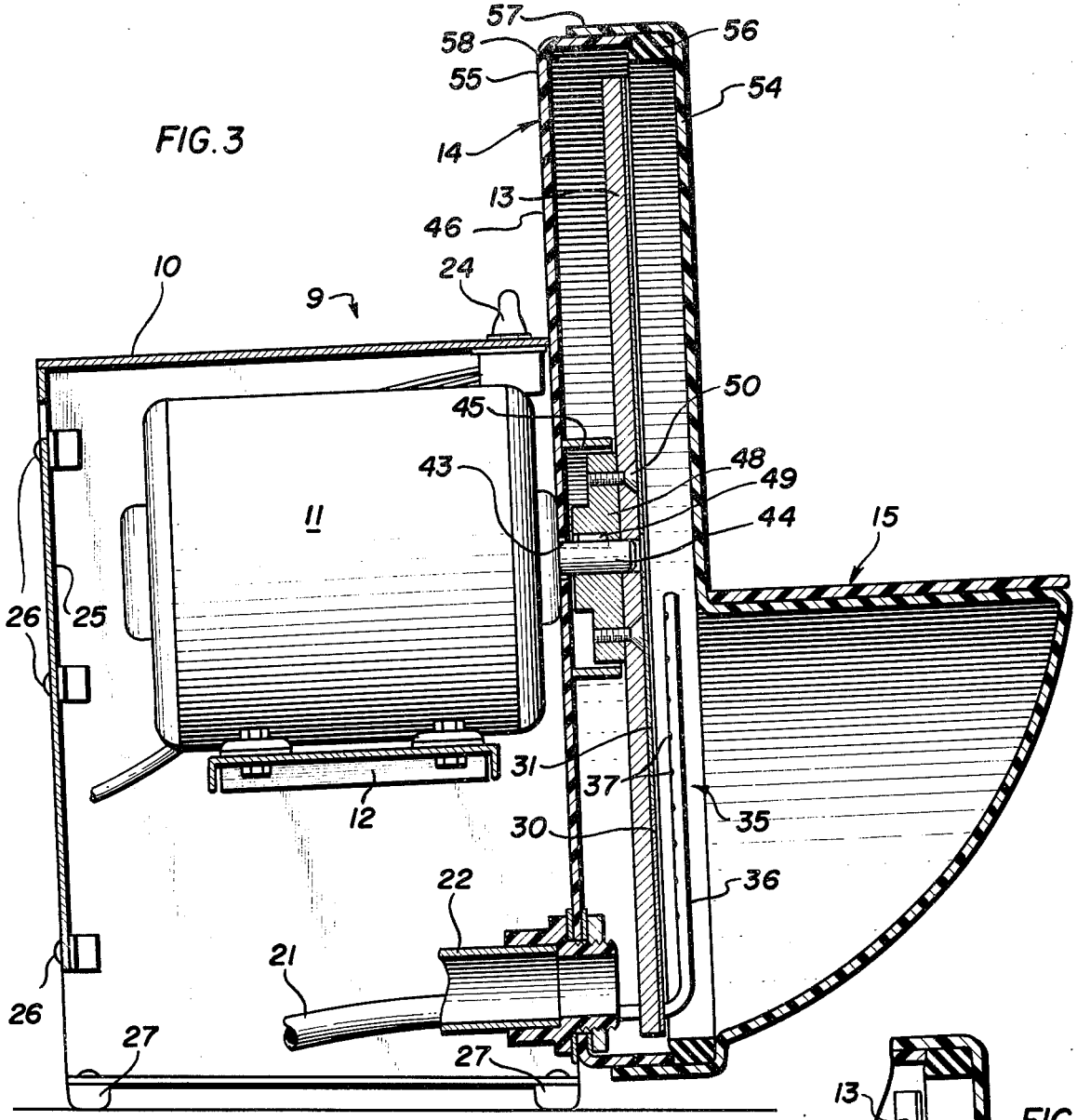
FIG. 3 is an elevational sectional view taken substantially in the plane of line 3—3 in FIG. 1.

Turning first to FIGS. 1–3, there is shown a model trimming machine 9 embodying the present invention. In general, this machine 9 includes a stand 10 within which is carried a motor 11 upon a shelf 12 or other convenient mount. A wheel 13 is rotatably driven by the motor 11 within a housing 14. To support the workpiece dental models (not shown), a shelf 15 extends across the front of the housing 14. The front of the housing 14 is provided with an access opening 16 to permit the dental models to be urged toward the wheel 13 and against the grinding surface or surfaces.

Upon the shelf 15, guide grooves 18 can be conveniently formed to engage a foot (not shown) of an angulator device 19. By this arrangement, the angulator device 19 can be precisely oriented in a desired position and urged in a perpendicular direction toward and away from the wheel 13 to grind facets upon the workpiece model with great angular accuracy.

A liquid for flushing and cooling the grinding face such as water is brought to the machine through an intake hose 21, and waste water, grit, and ground-away plaster is lead away from the machine through discharge hose 22 to a plaster trap or to a sewer. If desired, a work light 23 of convenient design can be mounted upon the machine, and it is oriented to illuminate the shelf 15 and housing access opening 16. An off-on motor switch 24 is provided to actuate and halt the machine operation. At the rear of the stand 10, a cover 25 is attached by convenient screws 26 or other means, and provides access to the machine interior for motor or hose maintenance. In the illustrated embodiment the machine rests upon a number of cushioned feet 27, but the feet 27 can be removed and bolts substituted for rigidly mounting the machine 9 to a work table or other desired location.

In accordance with one aspect of the invention, two or more different grinding surfaces are provided upon the same wheel 13, and these grinding surfaces can be rapidly and easily changed when desired. To this end, the machine 9 includes a first abrasive disk 30 having a grinding face of a first abrasive quality, and a second abrasive disk 31 having a grinding face of second abrasive quality different from the first grinding face. Here, these different grinding disks 30 and 31 take the form of a sandpaper or emery cloth which are bonded to the wheel 13 by adhesive or any convenient type.

In the illustrated embodiment, the outer disk 30 is provided with an 80 grit relatively course surface, and the inner disk is provided with a relatively fine 600 grit surface, but other grits or surfaces could be used without departing from the invention. However, providing a coarse grit on the outer disk 30 permits the relatively strong coarse grit-backing paper bonding agent to effectively counteract the relatively high centrifugal forces applied to the grit near the wheel periphery and minimize grit loss and grinding surface wear.

For convenience and economy, the first abrasive disk 30 takes the form of an angular ring having a maximum radius equal to or slightly less than the maximum radius of the wheel 13. At an inner edge, the minimum radius of the ring disk 30 is substantially equal to the maximum radius of the smaller disk 31. This arrangement permits the two different abrasive disks 30 and 31 to be concentrically mounted upon the wheel 13 without overlap or interference. When one disk wears out or becomes loaded with plaster or other abraded material, the disk can be simply peeled from the backup wheel 13 and replaced with a fresh disk with minimum expenditure of money and maintenance time.

As shown in FIG. 1, this arrangement of disks 30 and 31 permits model trimming at maximum efficiency in minimum time. A single access hole 16 in the housing 14 is elongated to extend over most of the wheel radius, and to extend past both the abrasive disks 30 and 31 mounted upon the wheel 13. Thus, the workpiece can be urged first against the relatively coarse-surface disk 30 for preliminary forming. The workpiece is then moved toward the center of the wheel and urged against the inner disk 31 for final facet machining and shaping. In the present embodiment, the access hole 16 is also extended in an elevational direction to increase the amount of abrasive cutting surface available for quick and accurate trimming operations.

As shown in FIGS. 2 and 3, the machine is provided with structure for directing a flushing and cooling stream of water or other liquid against the face of the abrasive disk or disks. To this end, a fluid distribution device 35 includes an elongated pipe 36 provided with a plurality of liquid-dispensing holes 37 spaced therealong. It is a feature of the invention that a coupling connection 38 permits the pipe 36 to be swung from a fluid-distribution position overlying the face of both disks 30 and 31 as shown in FIG. 3 to a disk-maintenance position out of the overlying position shown in FIG. 2 which permits a disk 30 or 31 to be removed from the wheel 13 and the installation of a fresh disk on the wheel without interference by the pipe 36.

It is another feature of the invention that flush water, grit and abraded plaster is discouraged from passing through the access hole 16 and out of the machine. To this end, as shown particularly in FIG. 6, the housing access hole 16 is partially defined by a flange 40 extending from the housing 14 toward the disks 30 and 31 sufficiently closely to discourage passage of material out of the interior of the hollow housing 14. Since the housing 14 is made of high-impact plastic, inadvertent minor misalignment of the housing flange which brings it into engagement with a grinding disk does not damage the machine; rather, the flange 40 is simply abraded away to provide only a minor disk-housing flange gap of the type described.

In further accordance with the invention, means are provided to discourage the passage of liquid, grit or abraded plaster through another housing aperture 43 at the rear of the housing 14. As shown particularly in FIG. 3, the motor 12 is provided with a shaft 44 extending through the aperture 43 and connecting the motor 11 to the wheel 13. Surrounding the shaft 44 and housing shaft aperture 43 is a shroud 45 which extends from a rear wall 46 of the housing toward the wheel 13 and terminates adjacent the wheel 13 sufficiently closely to discourage passage of liquid from the housing interior as described above. In the illustrated embodiment, a built-up hub 48 interconnects the shaft 44 and wheel 13, as by a hub-shaft key way and key 49 and by hub-wheel screws 50 or other convenient means. When the machine is thus constructed, the shroud 45 has an internal diameter just slightly larger than the maximum diameter of the built-up hub 48 to further discourage the passage of liquid, grit and plaster between the hub 48 and shroud 45 and through the housing aperture 43.

Not only is liquid, abraded plaster and grit discouraged from passing from the housing interior to places outside the machine, but this material is positively retained within the housing 14 for drainage through the discharge hose 22. In accordance with this aspect of the invention, the housing 14 comprises two flanged housing members 54 and 55 which are formed to substantially surround the wheel 13. An annular gasket 56 is carried in a corner of a first housing member 54 adjacent a housing member axially oriented flange 57. The opposite or second housing member 55 is also provided with a flange 58, but this flange 58 is sized to telescope into the first housing member 54. When the housing members are located at mutual predetermined position of telescopic engagement as illustrated in FIG. 3, the gasket 56 is compressed to a predetermined extent and provides a fluid-tight seal of maximum effectiveness at minimum cost.

In accordance with yet another aspect of the invention, the housing members 54 and 55 are retained in their mutually telescoped positions by quick-release fasteners as illustrated in FIGS. 2 and 3. In the illustrated embodiment, this quick-release mechanism includes a number of fingers 60 fixed either to the rear housing member 55 itself or to the stand 10 and a corresponding plurality of over-center clamps 61 mounted upon the other housing member 54 in positions for engaging the finger 60 and drawing the housing members 54 and 55 into the described mutually telescoped positions. Since both the fingers and the clamps are mounted outside the housing members 54 and 55, fouling by liquid, grit and abraded waste material contained inside the housing is prevented, and easy mechanism manipulation is provided. This, when it is desired to change a disk 30 or 31, the first housing member 54 can be easily withdrawn from the front of the machine by simply releasing the clamps 61 from their engaging fingers 60. The housing member 54 is then telescopically removed from the machine, the water pipe 36 is swung out of the way, and the subject disk is peeled away from the wheel 13. A fresh disk is installed, and the machine is then quickly and easily reassembled.

Figure 4:
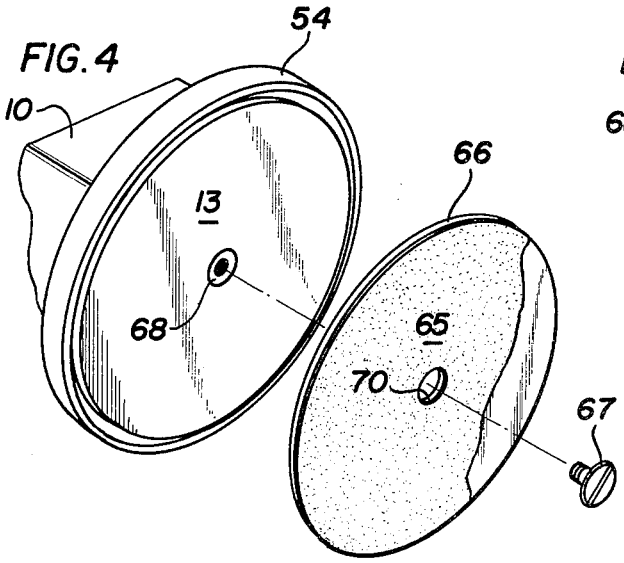
FIG. 4 is an exploded view similar to FIG. 2 but showing an alternate embodiment of the machine wheel and associated parts.
Figure 5:
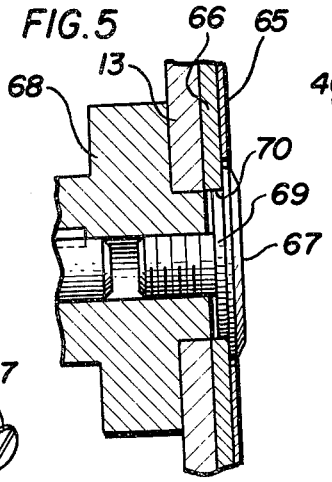
FIG. 5 is a fragmentary sectional view taken substantially in the plane of line 3—3 in FIG. 1 showing in further detail the embodiment shown in FIG. 4.
Figure 6:
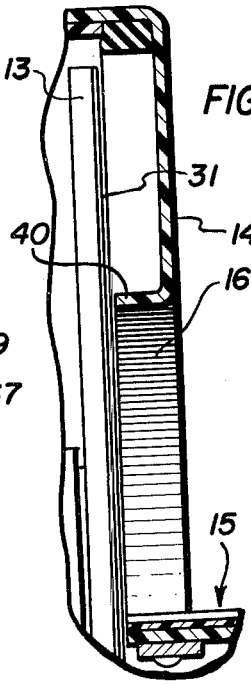
FIG. 6 is a fragmentary sectional view taken substantially in the plane of line 6—6 in FIG. 5.

As an alternative to the foregoing construction, a sandpaper, emery cloth, or other abrasive disk 65 can be either temporarily or permanently secured to an intermediate backup plate 66, as illustrated in FIGS. 4 and 5. The backup plate 66 is then superimposed over the wheel 13 and is drawn toward the plate 13 by a quick change screw member 67 threadably received in a wheel hub 68 located at the coincident axes of both the plate 66 and wheel 13. This screw 67 is provided with a stepped head 69 which engages a stepped aperture 70 formed at the center of the plate 66 for radially aligning the plate 66 with the wheel 13, as illustrated in FIG. 6. Rapid grinding face change is also encouraged with this arrangement: the first housing member 54 is removed, and the screw 67 is withdrawn. This action frees the plate 65 and its bonded disk 65 or abrasive surface for removal and replacement by another disk and surface. It will be understood that a grinding wheel could be substituted for the plate 66 and disk 65 without departing from at least the quick-change aspects of the invention.

The invention is claimed as follows:

1. A dental model trimmer machine comprising a rotatable wheel, a first abrasive disk, a temporary bonding material temporarily bonding the first disk to the wheel during model trimmer use and permitting the disk to be peeled from the wheel after model trimmer use, a loadable, removable grinding material of first abrasive quality, a grit bonding material bonding the first grinding material to the disk and permitting controlled removal of some first grinding material during model trimmer use, a second abrasive disk, a temporary bonding material temporarily bonding the second disk to the wheel concentrically with the first disk during model trimmer use and permitting the disk to be peeled from the wheel after model trimmer use, a loadable, removable grinding material of second abrasive quality different from the first grinding material, a grit bonding material permanently bonding the second grinding material to the disk and permitting controlled removal of some second grinding material during model trimmer use, a wheel housing providing a single grinding access extending past all the abrasive disks, an elongated fluid distributing pipe extending over the face of the wheel-mounted disks to distribute a grinding fluid to all the disks, coupling means permitting the pipe to be swung out of its disk overlying position to permit a disk to be peeled from the wheel and to permit a fresh disk to be installed on the wheel without interference by the pipe, motor means for rotating the wheel in the housing at a model trimming speed, shaft means extending through a housing aperture and connecting the motor means to the wheel, and shroud means surrounding the housing aperture and shaft means and extending from the housing means toward the wheel sufficiently closely to discourage the passage of liquid between the wheel and the shroud means.

2. A dental model trimmer according to claim 1 wherein said housing access includes a flange extending from the housing toward the disk sufficiently closely to discourage the passage of liquid from the housing interior through the access.

3. A dental model trimmer according to claim 1 including hub means interconnecting the shaft means and the wheel, extending from the wheel toward the housing and having a maximum diameter less than the internal diameter of the shroud to further discourage the passage of liquid between the hub and the shroud.

4. A dental model trimmer according to claim 1 wherein said wheel housing includes first and second flanged housing members for substantially surrounding the wheel, a gasket member carried in one housing member adjacent its flange in a position for compressive engagement by the opposite housing member flange, quick release fastener means including a plurality of fingers fixed relative to one housing member and a corresponding plurality of over-center clamps fixed relative to the other housing member for engaging the fingers and drawing one housing member partially into the other at mutual predetermined positions of telescopic engagement for compressing the gasket member to a predetermined extent, and means for mounting said quick release fastener means outside said housing means to prevent fastener fouling by liquid, grit and abraded waste material.

* * * * *